US009640857B2

(12) United States Patent
Nakagawa et al.

(10) Patent No.: US 9,640,857 B2
(45) Date of Patent: May 2, 2017

(54) COMMUNICATION MODULE

(71) Applicant: ALPS ELECTRIC CO., LTD., Tokyo (JP)

(72) Inventors: Masashi Nakagawa, Miyagi-ken (JP); Kazuya Ishikawa, Miyagi-ken (JP); Yoshihisa Shibuya, Miyagi-ken (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 14/949,147

(22) Filed: Nov. 23, 2015

(65) Prior Publication Data

US 2016/0156092 A1 Jun. 2, 2016

(30) Foreign Application Priority Data

Nov. 27, 2014 (JP) ..... 2014-240334

(51) Int. Cl.
*H01Q 1/24* (2006.01)
*H01Q 1/38* (2006.01)
*H01Q 9/42* (2006.01)

(52) U.S. Cl.
CPC ..... *H01Q 1/24* (2013.01); *H01Q 1/38* (2013.01); *H01Q 9/42* (2013.01)

(58) Field of Classification Search
CPC ..... H01Q 1/24; H01Q 1/40
See application file for complete search history.

(56) References Cited

U.S. PATENT DOCUMENTS

2014/0117515 A1* 5/2014 Lachner ..... H01Q 1/2283 257/664
2014/0285389 A1* 9/2014 Fakharzadeh ..... H01P 5/107 343/786
2014/0293529 A1* 10/2014 Nair ..... H01Q 1/2283 361/679.31

FOREIGN PATENT DOCUMENTS

JP 2009-290553 A 10/2009

* cited by examiner

*Primary Examiner* — Dameon E Levi
*Assistant Examiner* — Andrea Lindgren Baltzell
(74) *Attorney, Agent, or Firm* — Brinks Gilson & Lione

(57) ABSTRACT

A communication module includes a circuit board having electronic components thereon, an insulative molded member encapsulating the electronic components on the circuit board, and an antenna unit on the molded member. The circuit board is electrically connected to the antenna unit through a post terminal. The antenna unit and the molded member define a cavity therebetween.

7 Claims, 8 Drawing Sheets

COMMUNICATION MODULE

CLAIM OF PRIORITY

This application claims benefit of priority to Japanese Patent Application No. 2014-240334 filed on Nov. 27, 2014, which is hereby incorporated by reference.

BACKGROUND

1. Field of the Disclosure

The present disclosure relates to a wireless communication module for data communication.

2. Description of the Related Art

Japanese Unexamined Patent Application Publication No. 2009-290553 discloses a high-frequency module including an antenna suitable for radio communication equipment. This high-frequency module includes a circuit board having a plurality of circuit components thereon, a molded resin member covering the circuit components on the circuit board, and the antenna, which is flat, on the molded resin member.

In the above-described related-art module, the molded resin member, which is insulative, is placed under the planar antenna. The antenna is capacitively coupled to the molded resin member. In other words, the characteristics of the antenna are affected by the dielectric constant of the molded resin member. This restricts selection of a material for the molded resin member and circuit design. Furthermore, the circuit board, the planar antenna, and the molded resin member have different coefficients of thermal expansion. The circuit board or the planar antenna may be strained upon molding or depending on the environment, leading to a degradation in performance.

SUMMARY

A communication module includes a circuit board having a plurality of electronic components thereon, an insulative encapsulating member covering the electronic components on the circuit board, and a plate-shaped antenna unit on the encapsulating member. The circuit board is electrically connected to the antenna unit through a connecting member. The antenna unit and the encapsulating member define a cavity therebetween.

In this communication module, the cavity between the antenna unit and the encapsulating member allows a reduction in capacitive coupling between the antenna unit and the encapsulating member, made of resin, as compared with that in the related art, resulting in reduction of electrical effects of the encapsulating member on the antenna unit. Furthermore, the above-described configuration can minimize strain caused by thermal expansion of the encapsulating member made of resin.

DESCRIPTION OF THE EXEMPLARY EMBODIMENTS

Communication modules according to embodiments of the present invention will be described with reference to the drawings. The drawings are for illustration purposes only and are not drawn to scale.

Figure 1:
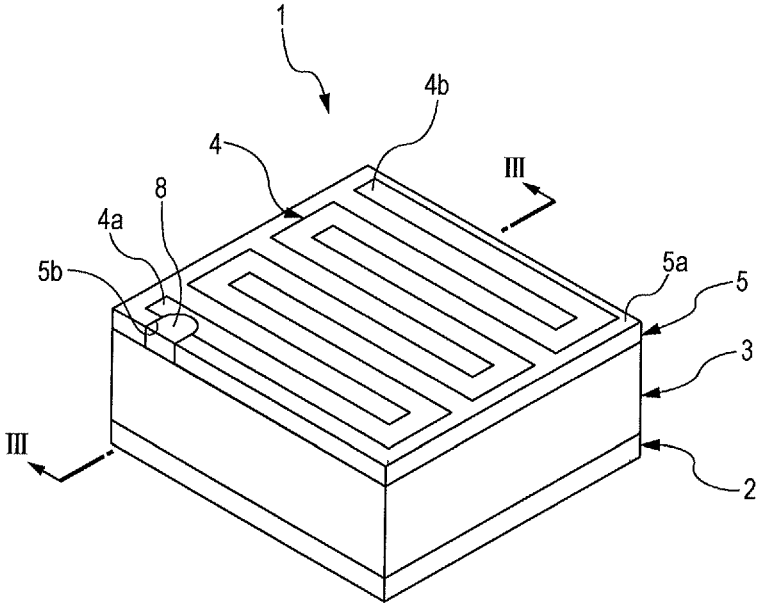
FIG. 1 is a perspective view of a communication module according to a first embodiment of the present invention.
Figure 2:
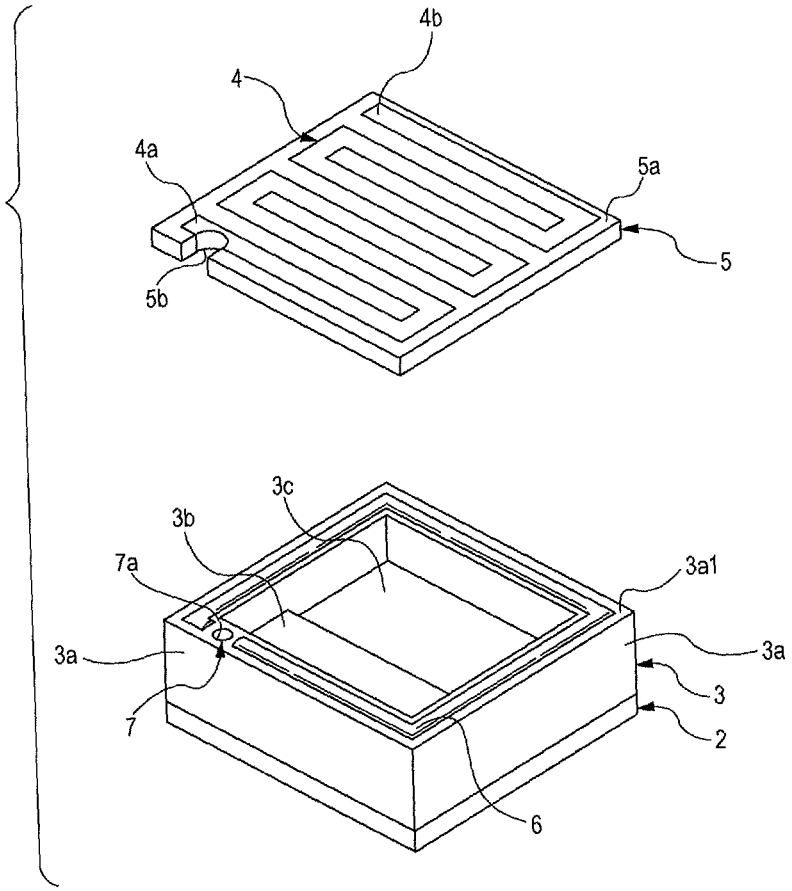
FIG. 2 is an exploded perspective view of the communication module of FIG. 1.
Figure 3:
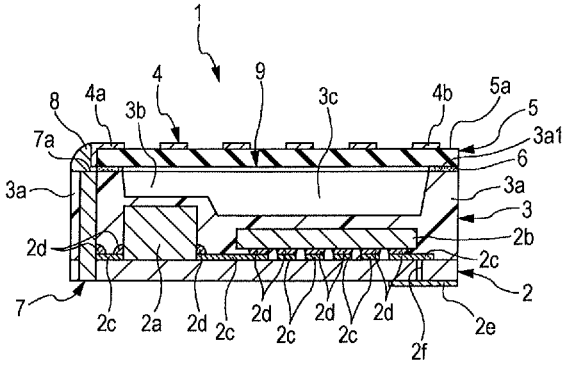
FIG. 3 is a cross-sectional view of the communication module taken along the line III-III in FIG. 1.

As illustrated in FIGS. 1 to 3, a communication module 1 according to a first embodiment of the present invention includes a circuit board 2 having electronic components 2*a* and 2*b* thereon, a molded member 3, serving as an encapsulating member, and a plate-shaped antenna unit 5 including an antenna pattern 4.

In the present embodiment, the electronic component 2*a* may be an electronic component having a relatively high height, for example, a coil or an oscillator. The electronic component 2*b* may be an integrated circuit having a lower height than the electronic component 2*a*. The electronic components 2*a* and 2*b* are electrically connected through solder 2*d* to a circuit pattern 2*c* formed of copper foil on the circuit board 2. The circuit board 2 has a lower surface having thereon a circuit pattern 2*e*, serving as an external connection terminal of the communication module 1. The circuit pattern 2*e* is electrically connected to the above-described circuit pattern 2*c* via a through-hole 2*f*.

The molded member 3 is made of insulating resin, such as epoxy resin or silicone resin. The molded member 3 covers and encapsulates the electronic components 2*a* and 2*b* on the circuit board 2. The molded member 3 may include a wall portion 3*a* extending along an outer edge of the circuit board 2, a recess 3*b* having a depth associated with the height of the electronic component 2*a* on the circuit board 2, and a recess 3*c* having a depth associated with the height of the electronic component 2*b* on the circuit board 2. The wall portion 3*a* has an upper edge 3*a*1 on which the antenna unit 5 is mounted, with an adhesive 6 therebetween. As is seen from FIG. 3, the recess 3*c* is deeper than the recess 3*b* in the present embodiment.

A cylindrical post terminal 7, serving as a connecting member for electrically connecting the circuit board 2 to the antenna unit 5, is placed in the wall portion 3*a* of the molded member 3. The post terminal 7 is connected at a point adjacent to its lower end to the circuit pattern 2*c* of the circuit board 2 through the solder 2*d*. The post terminal 7 having an upper end face 7*a* is placed such that the upper end face 7*a* is flush with the upper edge 3*a*1 of the molded member 3.

The antenna unit 5 including an insulating substrate has an upper surface 5*a* on which the antenna pattern 4 including linear parts and having a length appropriate for a transmitting and receiving frequency is formed of copper foil. The antenna pattern 4 has two ends. One end of the two ends serves as a connection end 4*a* connected to the post terminal 7. The antenna pattern 4 extends to a connection recess 5*b* in a side surface of the antenna unit 5. The other end of the antenna pattern 4 is a free end 4*b*. The upper end face 7*a* of the post terminal 7 is electrically connected to the connection end 4*a* of the antenna pattern 4 through solder 8 in the connection recess 5*b*.

Referring to FIG. 3, the communication module 1 with the above-described configuration has a hermetically closed cavity 9 defined by the antenna unit 5 and the molded member 3 having the recesses 3*b* and 3*c*. The cavity 9 results in an increased distance between the molded member 3, which is a dielectric, and the antenna pattern 4, thus reducing electrical effects of the molded member 3 on antenna characteristics.

The antenna pattern 4 in the present embodiment has a monopole structure having a first end that is free. The free end 4*b* of the antenna pattern 4 is electrically more unstable than the connection end 4*a*. In the present embodiment, the height of a portion of the cavity 9 (or the depth of the recess 3*c*) adjacent to the free end 4*b* of the antenna pattern 4 may be made greater than the height of another portion of the cavity 9 (or the depth of the recess 3*b*) adjacent to the connection end 4*a* to form steps. This achieves further reduction of electrical effects of the molded member 3 on the free end 4*b*.

A method of making the communication module 1 will now be described. The solder 2*d* in paste form is applied to an upper surface of the circuit board 2 having the circuit patterns 2*c* and 2*e* thereon. The circuit board 2 is then allowed to pass through a reflow oven, thus fixing the electronic components 2*a* and 2*b* and the post terminal 7 to the circuit board 2. After that, the method proceeds to a molding step.

Figure 4:
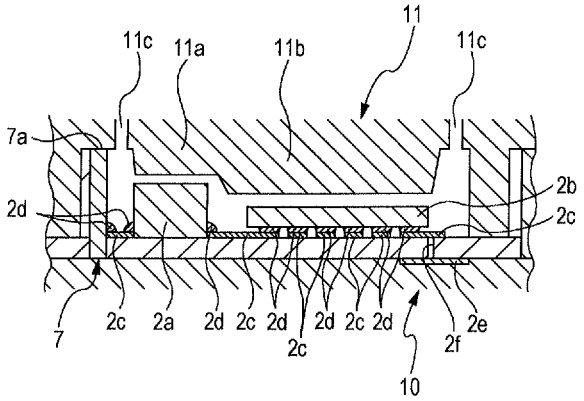
FIG. 4 is a cross-sectional view illustrating a molding die for the communication module taken along the line III-III in FIG. 1 before formation of a molded member of the communication module.
Figure 5:
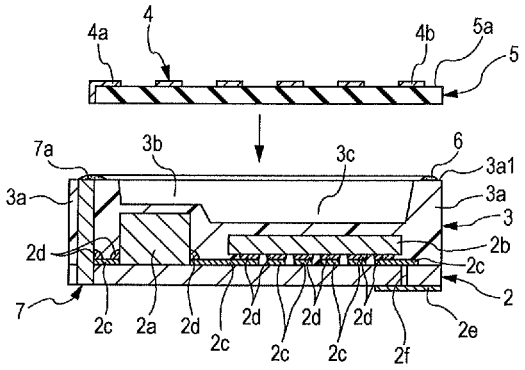
FIG. 5 is a cross-sectional view illustrating the molded member of the communication module taken along the line III-III in FIG. 1 before attachment of an antenna unit.

As illustrated in FIG. 4, a molding die includes a plate-shaped lower die segment 10 and an upper die segment 11. The upper die segment 11 is in contact with the upper surface of the circuit board 2 such that the circuit board 2 is sandwiched between the lower die segment 10 and the upper die segment 11. The upper die segment 11 has a protrusion 11*a* and a protrusion 11*b* formed so that each of the protrusions 11*a* and 11*b* is at a predetermined distance from the upper surface of the corresponding one of the electronic components 2*a* and 2*b*. The upper die segment 11 further has injection ports 11*c*, through which mold resin is injected, such that the injection ports 11*c* open at a level corresponding to the upper edge 3*a*1 of the wall portion 3*a* of the molded member 3. Each of the protrusions 11*a* and 11*b* of the upper die segment 11 has a sloping side surface to enhance the flowability of the mold resin in the die and to enable the upper die segment 11 to be easily removed after the mold resin is hardened. The mold resin is poured into the die through the injection ports 11*c* under pressure while the circuit board 2 is sandwiched between the upper die segment 11 and the lower die segment 10. Since each of the protrusions 11*a* and 11*b* of the upper die segment 11 is at a predetermined distance from the corresponding one of the electronic components 2*a* and 2*b*, the protrusion 11*b* of the upper die segment 11 is at a minimum distance from the circuit board 2. This allows the pressure under which the mold resin is poured to be increased, so that spacing between the electronic component 2*b* and the circuit board 2 is filled with the mold resin with no clearances. Thus, the electronic component 2*b* is firmly encapsulated in the molded member 3.

After the mold resin is hardened, the upper die segment 11 is removed. At this time, the upper edge 3*a*1 of the wall portion 3*a* of the molded member 3 may have unnecessary mold resin parts like burrs. The mold resin may be left on the upper end face 7*a* of the post terminal 7. After the upper die segment 11 is removed, therefore, the upper edge 3*a*1 of the wall portion 3*a* of the molded member 3 is polished to eliminate the unnecessary mold resin parts and flatten the upper edge 3*a*1 and the upper end face 7*a* of the post terminal 7. After that, the adhesive 6 is applied to the upper edge 3*a*1 and the antenna unit 5 is attached to the upper edge 3*a*1 to hermetically seal the communication module 1, thus forming the cavity 9.

Then, the connection end 4*a* of the antenna pattern 4 is electrically connected to the upper end face 7*a* of the post terminal 7 with the solder 8 in the connection recess 5*b* of the antenna unit 5. Thus, the communication module 1 is completed.

The communication module 1 has the cavity 9 on the molded member 3. The dielectric loss tangent of part including the molded member 3 (particularly, the recesses 3*b* and 3*c*), serving as a dielectric, and the antenna unit 5 (particularly, the antenna pattern 4) is accordingly smaller than that in the related art. Consequently, the antenna pattern 4 is little affected by the dielectric constant of the molded member 3, thus enabling the antenna unit 5 to have stable electrical characteristics. In addition, the cavity 9 allows the strain of the entire communication module 1 caused by the difference in coefficient of thermal expansion among the molded member 3, the circuit board 2, and the antenna unit 5 to be reduced as compared with that in the related art, and also allows a reduction in amount of mold resin used, leading to a reduction in cost. In the present invention, the antenna pattern 4 has a monopole structure and the free end 4*b* of the antenna pattern 4 is accordingly electrically more unstable than the connection end 4*a* thereof. In the present embodiment, the recess 3*c* of the molded member 3 adjacent to the free end 4*b* of the antenna pattern 4 is made deeper than the recess 3*b* adjacent to the connection end 4*a*, thus further reducing the electrical effects of the molded member 3 on the antenna characteristics. This facilitates designing the circuitry of the entire communication module 1.

Figure 6:
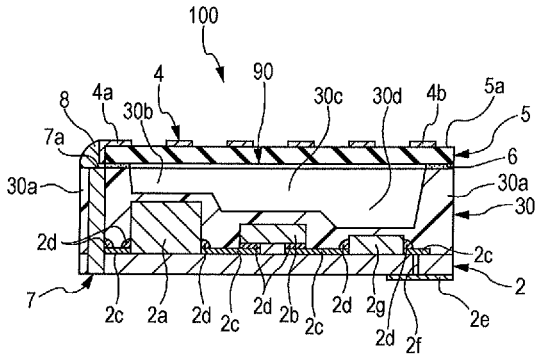
FIG. 6 is a cross-sectional view of a communication module according to a second embodiment of the present invention taken along a line corresponding to the line III-III in FIG. 1.

FIG. 6 illustrates a communication module 100 according to a second embodiment of the present invention. FIG. 6 is a cross-sectional view of the communication module 100 taken along a line corresponding to the line III-III in FIG. 1 in the first embodiment. The same components as those in the first embodiment are designated by the same reference numerals and a detailed description of these components is omitted.

The communication module 100 according to the present embodiment further includes an electronic component 2*g* in addition to the components of the communication module 1 according to the first embodiment. The electronic component 2*g* is a small component, such as a resistor or a capacitor, and has a lower height than the electronic component 2*b*. In this case, the electronic components 2*a*, 2*b*, and 2*g* are arranged in order of decreasing height in a direction from the connection end 4*a* of the antenna pattern 4 to the free end 4*b*. A molded member 30 includes a wall portion 30*a* and has recesses 30*b*, 30*c*, and 30*d* surrounded by the wall portion 30*a*. The recesses 30*b*, 30*c*, and 30*d* have different depths associated with the heights of the electronic components 2*a*, 2*b*, and 2*g*. In the communication module 100, a cavity 90 can accordingly be maximized in association with the shapes of the electronic components mounted on the circuit board 2.

Figure 7:
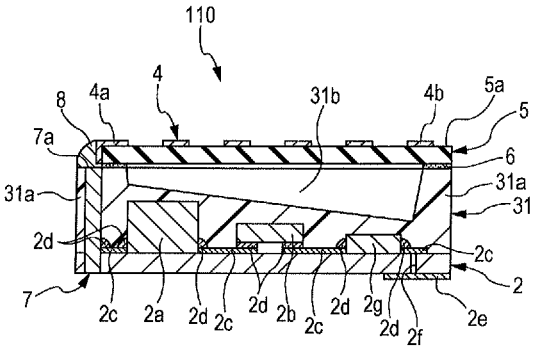
FIG. 7 is a cross-sectional view of a communication module according to a third embodiment of the present invention taken along a line corresponding to the line III-III in FIG. 1.

FIG. 7 illustrates a communication module 110 according to a third embodiment of the present invention. FIG. 7 is a cross-sectional view of the communication module 110 taken along a line corresponding to the line III-III in FIG. 1 in the first embodiment. The same components as those in the first and second embodiments are designated by the same reference numerals and a detailed description of these components is omitted.

The third embodiment differs from the second embodiment in that a recess 31*b* surrounded by a wall portion 31*a* of a molded member 31 has a surface sloping down in the direction from the connection end 4*a* of the antenna pattern 4 to the free end 4*b*. This facilitates simplification of a die for forming the molded member 31 in addition to achieving the same advantages offered by the second embodiment.

Figure 8:
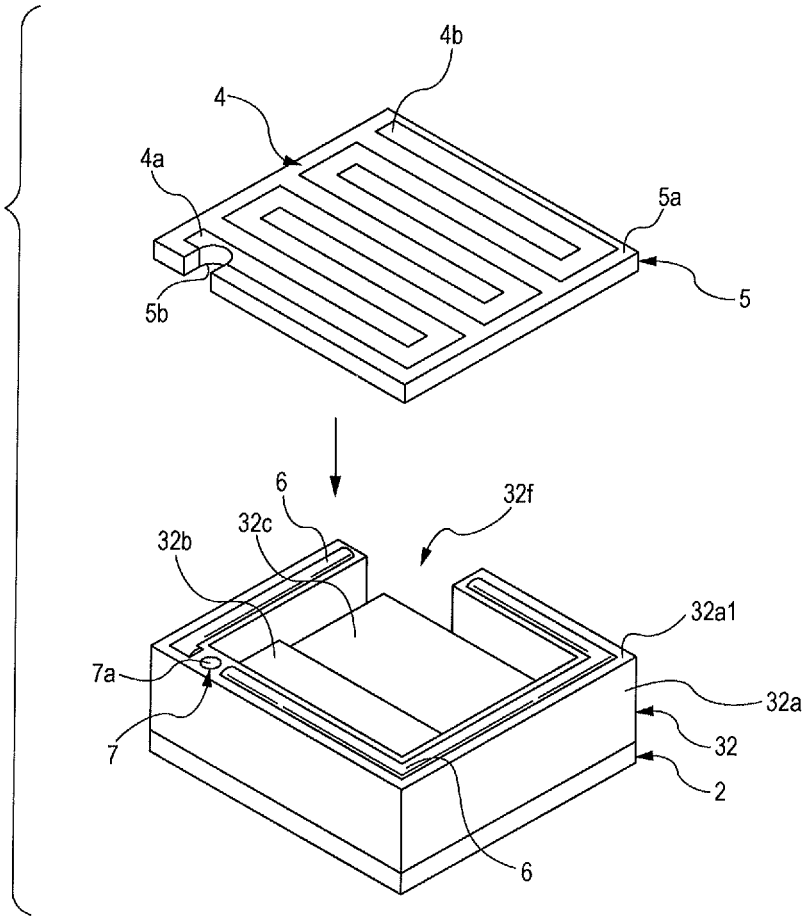
FIG. 8 is an exploded perspective view of a communication module according to a fourth embodiment of the present invention.
Figure 9:
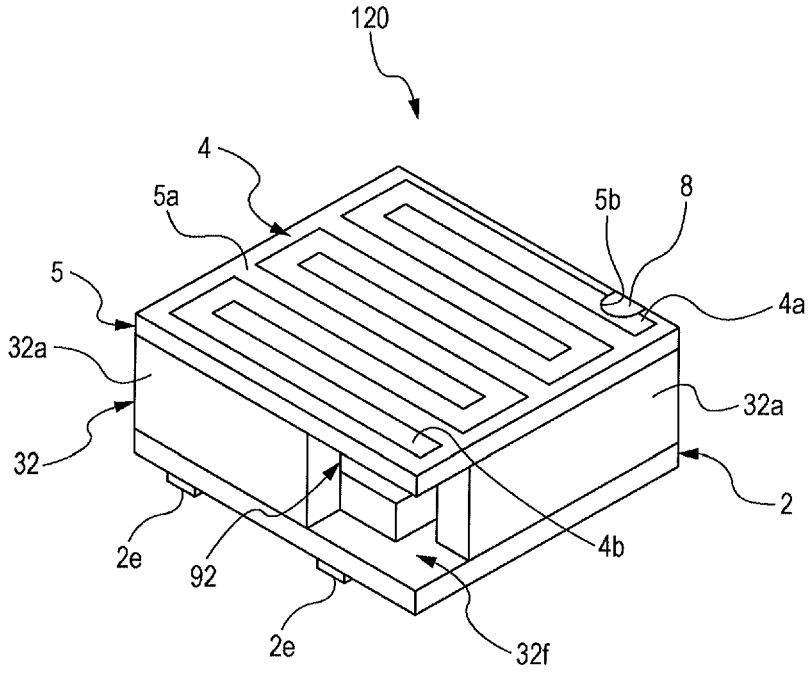
FIG. 9 is a perspective view of the communication module of FIG. 8 when viewed in a direction opposite to the direction in FIG. 8.

FIG. 8 is an exploded perspective view of a communication module according to a fourth embodiment of the present invention. FIG. 9 is a perspective view of the communication module according to the fourth embodiment. The same components as those in the first embodiment are designated by the same reference numerals and an explanation of these components is omitted.

The communication module, indicated at 120, according to the present embodiment includes the circuit board 2 and a molded member 32 on the circuit board 2 as in the first embodiment. The molded member 32 may include a wall portion 32*a* and have recesses 32*b* and 32*c* and a gap 32*f* that is under the free end 4*b* of the antenna pattern 4. The adhesive 6 is applied to an upper edge 32*a* of the wall portion 32*a* and the antenna unit 5 is attached to the molded member 32, thus forming a cavity 92 between the molded member 32 and the antenna unit 5. As described above, the free end 4*b* of the antenna pattern 4 is electrically the most unstable and is accordingly most affected by the molded member 30, serving as a dielectric. The above-described configuration, however, has the gap 32*f* under the free end 4*b* in addition to the cavity 92, thus enabling the antenna pattern 4 to have more stable electrical characteristics. Furthermore, the cavity 92 opens through the gap 32*f*. This eliminates an adverse effect on the communication module 120 caused by expansion or contraction of air in the cavity 92 in response to a change in environment.

Figure 10:
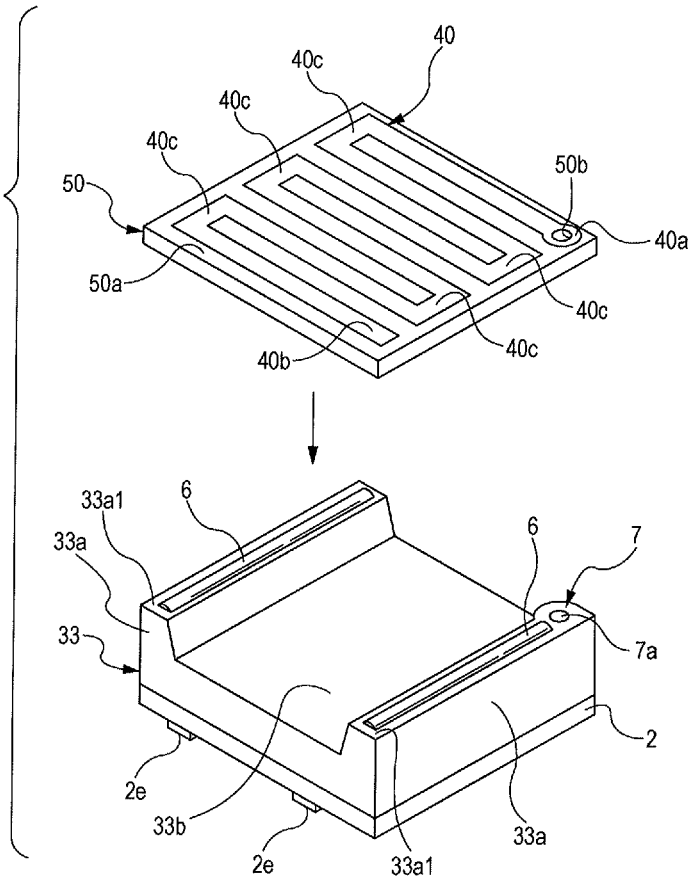
FIG. 10 is an exploded perspective view of a communication module according to a fifth embodiment of the present invention.
Figure 11:
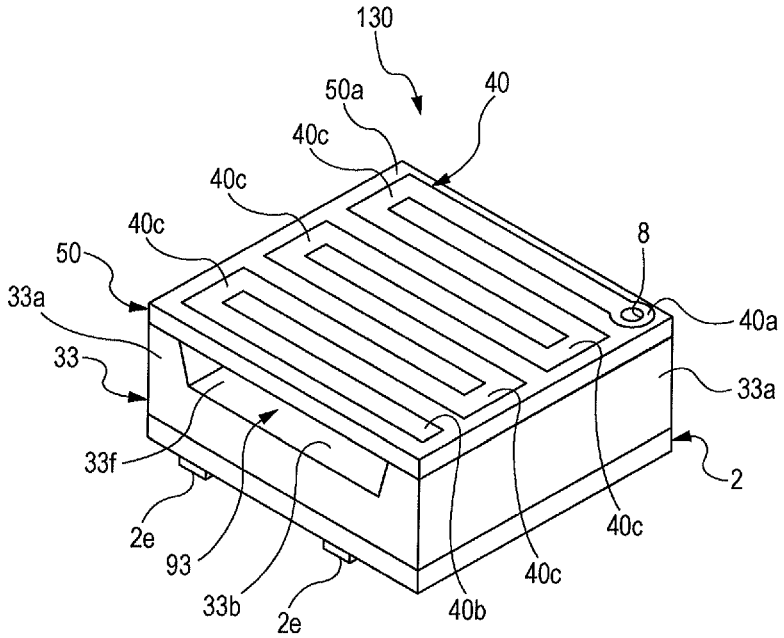
FIG. 11 is a perspective view of the communication module of FIG. 10.

FIG. 10 is an exploded perspective view of a communication module according to a fifth embodiment of the present invention. FIG. 11 is a perspective view of the communication module according to the fifth embodiment. The same components as those in the first embodiment are designated by the same reference numerals and an explanation of these components is omitted.

The communication module, indicated at 130, according to the fifth embodiment includes the circuit board 2 and a molded member 33 covering the circuit board 2. The molded member 33 includes two wall portions 33*a* each having an upper edge 33*a*1, and has a U-shaped recess 33*b*. The upper end face 7*a* of the cylindrical post terminal 7 electrically connected to the circuit board 2 is exposed at the upper edge 33*a*1 of one of the wall portions 33*a* of the molded member 33. The communication module 130 further includes an antenna unit 50 including a film member made of, for example, polyethylene terephthalate (PET). The antenna unit 50 has an upper surface 50*a* having an antenna pattern 40 thereon. The antenna pattern 40 has a connection end 40*a* having a through-hole 50*b*, a free end 40*b*, and short linear parts 40*c*. The antenna unit 50 is attached to the upper edges 33*a*1 of the wall portions 33*a* of the molded member 33 with the adhesive 6 such that the short linear parts 40*c* extend along the upper edges 33*a*1 of the molded member 33. After that, the solder 8 is applied to the through-hole 50*b* of the antenna unit 50, thus electrically connecting the connection end 40*a* of the antenna pattern 40 to the upper end face 7*a* of the post terminal 7.

In the fifth embodiment, the recess 33*b* of the molded member 33 and the antenna unit 50 define a space that serves as a cavity 93. A space under one end of the antenna unit 50 in which the free end 40*b* is placed may serve as a gap 33*f*.

The fifth embodiment achieves further reduction in amount of mold resin used and facilitates simplification of the structure of a die, leading to a reduction in cost. Additionally, the amount of the mold resin under the antenna pattern 40 can be further reduced, thus further reducing the effects of the mold resin on the antenna unit 50.

The present invention is not limited to the above-described embodiments. The present invention may be appropriately modified without departing from the scope of the present invention.

What is claimed is:

1. A communication module comprising:

a circuit board having a plurality of electronic components thereon;

an insulative encapsulating member covering the electronic components on the circuit board, the encapsulating member including a wall portion provided in an outer peripheral area of a top portion of the encapsulating member, and a recess portion provided in the residual area of the top portion of the encapsulating member so as to be surrounded by the wall portion;

a plate-shaped antenna unit on the encapsulating member, the antenna unit including an insulating substrate provided on the wall portion of the encapsulating member, and an antenna pattern on a top surface of the insulating substrate so as to be located on the opposite side of the encapsulating member through the insulating substrate;

the circuit board being electrically connected to the antenna unit through a connecting member; and a bottom surface of the insulating substrate and the recess portion of the encapsulating member defining a cavity therebetween.

2. The module according to claim 1, wherein the encapsulating member has steps in the cavity such that the steps correspond to heights of the electronic components on the circuit board.

3. The module according to claim 1, wherein the electronic components include at least one integrated circuit and the encapsulating member on the integrated circuit is at a maximum distance from the antenna unit in the cavity.

4. The module according to claim 1, wherein the wall portion extends along an outer edge of a bottom surface of the antenna unit.

5. The module according to claim 1, wherein the encapsulating member has a gap extending through a side portion of the encapsulating member.

6. The module according to claim 5, wherein the antenna pattern has a monopole structure having a first end that serves as a free end and a second end that serves as a connection end electrically connected to the circuit board, and the gap is under the free end of the antenna pattern.

7. The module according to claim 1, wherein the bottom surface of the insulating substrate is fixed on the wall portion of the encapsulating member with an adhesive.

* * * * *